US012320358B2

(12) United States Patent
Lalchandani et al.

(10) Patent No.: US 12,320,358 B2
(45) Date of Patent: Jun. 3, 2025

(54) ELEMENT, DEVICE AND METHOD FOR COMPRESSION OF A GAS TO BE COMPRESSED HAVING A LOW TEMPERATURE

(71) Applicant: ATLAS COPCO AIRPOWER, NAAMLOZE VENNOOTSCHAP, Wilrijk (BE)

(72) Inventors: Mukesh Lalchandani, Wilrijk (BE); Tom Van Troos, Wilrijk (BE); Simon De Bock, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 0 days.

(21) Appl. No.: 18/284,198

(22) PCT Filed: Mar. 23, 2022

(86) PCT No.: PCT/EP2022/057665
§ 371 (c)(1),
(2) Date: Sep. 26, 2023

(87) PCT Pub. No.: WO2022/214318
PCT Pub. Date: Oct. 13, 2022

(65) Prior Publication Data

US 2024/0301879 A1 Sep. 12, 2024

(30) Foreign Application Priority Data

Apr. 9, 2021 (BE) ..... 2021/5279

(51) Int. Cl.
*F04C 29/04* (2006.01)
*F04C 18/08* (2006.01)
(Continued)

(52) U.S. Cl.
CPC ..... *F04C 29/04* (2013.01); *F04C 18/086* (2013.01); *F04C 18/16* (2013.01); *F04C 29/02* (2013.01);
(Continued)

(58) Field of Classification Search
CPC .... F04C 29/04; F04C 15/0096; F04C 18/086; F04C 18/16; F04C 29/02; F04C 29/042; F04C 2220/12; F04C 2240/50
See application file for complete search history.

(56) References Cited

U.S. PATENT DOCUMENTS 8,435,020 B2 * 5/2013 Amano ..... F04C 18/16 418/98
2006/0182647 A1 * 8/2006 Kamikawa ..... F04C 18/16 418/206.8
(Continued)

FOREIGN PATENT DOCUMENTS

EP 3587817 A1 1/2020
JP 61-226583 A 10/1986
(Continued)

OTHER PUBLICATIONS

International Search Report of PCT/EP2022/057665 dated Jun. 13, 2022 [PCT/ISA/210].
(Continued)

*Primary Examiner* — Mary A Davis
(74) *Attorney, Agent, or Firm* — Sughrue Mion, PLLC

(57) ABSTRACT

An element for compression of a gas to be compressed having a low temperature of −40° C. or lower, which element (1) is provided with a housing (2) containing at least one rotor (3) which is mounted rotatably with its shaft (5) with respect to the housing (2) and with an inlet (6) for the gas to be compressed and an outlet (7) for compressed gas, characterized in that the element (1) is provided with a
(Continued)

heating means for an end (9*a*) of the shaft (5) of the rotor (3) located closest to the inlet (6).

20 Claims, 4 Drawing Sheets

(51) Int. Cl.
*F04C 18/16* (2006.01)
*F04C 29/02* (2006.01)

(52) U.S. Cl.
CPC ..... *F04C 29/042* (2013.01); *F04C 2220/12* (2013.01); *F04C 2240/50* (2013.01)

(56) References Cited

U.S. PATENT DOCUMENTS

| | | | | |
|---|---|---|---|---|
| 2019/0390671 | A1* | 12/2019 | Takaki ..... | F04C 29/04 |
| 2024/0191714 | A1* | 6/2024 | Lalchandani ..... | F04C 29/04 |

FOREIGN PATENT DOCUMENTS

| | | | |
|---|---|---|---|
| WO | 2013/168193 | A1 | 11/2013 |
| WO | 2018/047587 | A1 | 3/2018 |

OTHER PUBLICATIONS

Written Opinion of PCT/EP2022/057665 dated Jun. 13, 2022 [PCT/ISA/237].
International Preliminary Report on Patentability of PCT/EP2022/057665 dated Mar. 31, 2023 [PCT/IPEA/409].

* cited by examiner

ELEMENT, DEVICE AND METHOD FOR COMPRESSION OF A GAS TO BE COMPRESSED HAVING A LOW TEMPERATURE

CROSS REFERENCE TO RELATED APPLICATIONS

This application is a National Stage of International Application No. PCT/EP2022/057665 filed on Mar. 23, 2022, claiming priority based on Belgian Patent Application No. 2021/5279 filed on Apr. 9, 2021.

BACKGROUND OF THE INVENTION

Field of the Invention

The present invention relates to an element, device and method for compression of a gas to be compressed having a low temperature.

Background

In what follows, 'low temperature' refers to a temperature of −40° C. or lower. Therefore, the invention is intended for cryogenic applications.

One possible example is the compression of boil-off gases of liquefied natural gas (LNG), but the invention is not limited to that.

It is known that a reciprocating compressor or piston compressor is used for such applications.

A disadvantage of such reciprocating or piston compressors is that they generate pulsation in the compressed gas supply due to their action. In other words, the compressed gas supply is not continuous.

However, some applications require an uninterrupted supply of compressed gas.

It is known that, for instance, a screw compressor element with screw rotors produces continuous action without pulsations in the compressed gas supply. In addition, the energy consumption of a screw compressor element is lower as well.

However, a screw compressor is not suitable to be used for compressing gases with a temperature of −40° C. or lower.

A screw compressor element comprises a housing made of cast iron and screw rotors made of forged steel.

Significant thermal deformation occurs at such low temperatures.

The screw rotors are provided with a shaft which typically forms a single unit with a rotor body and they will cool down more on the inlet side of the screw compressor element than on the outlet side of the screw compressor element.

This creates a temperature gradient over the screw rotors from the inlet side to the outlet side.

This affects the tolerances and clearances in the screw compressor element, which will increase due to the thermal deformation, thereby reducing efficiency and performance of the screw compressor element.

Therefore, the gas to be compressed at a temperature of −40° C. or lower is warmed up before it enters the screw compressor element.

Although this solves the problem of the thermal deformation, it also causes substantial energy losses, because the compressed gas must be cooled down again after compression.

EP 3 587 817 A1 relates to a screw compressor including a screw rotor configured to compress a gas due to rotation of the screw rotor about an axis of the screw rotor and a casing housing the screw rotor rotatably and provided with a suction port for a gas, the casing being provided with a suction side space through which a gas flowing into the casing from the suction port and not yet sucked by the screw rotor flows. The casing is provided with a heating fluid passage for introducing a heating fluid into the suction side space so as to heat oil staying in the suction side space.

WO 2018/047587 A1 relates to an oil-free screw compressor which is provided with the following:

- a compressor body;
- a motor that drives the compressor body;
- a chamber that is interposed between the compressor body and the motor;
- a rotor shaft configured so that an input shaft portion that is located on the compressor body-side of the chamber, an output shaft portion that is located on the motor-side of the chamber, and an intermediate shaft portion that extends inside the chamber are formed integrally and coaxially; and
- a supply unit that supplies, to the inside of the chamber, a cooling medium for cooling the inside of the chamber.

The present invention aims at offering a solution to at least one of said and/or other disadvantages by providing an element which can compress gas to be compressed at a temperature of −40° C. or lower.

SUMMARY OF THE INVENTION

The present invention relates to the object of an element for compressing a gas to be compressed having a low temperature of −40° C. or lower, which element is provided with a housing containing at least one rotor which is mounted rotatably around its shaft with respect to the housing and with an inlet for the gas to be compressed and an outlet for compressed gas, with the characteristic that the element is provided with a heating means for an end of the shaft of the rotor located closest to the inlet.

An advantage is that it is possible to heat this aforementioned end of the shaft in this way.

The inlet of the element will be the coldest location as the gas to be compressed enters here at a low temperature. Consequently, the end of the shaft located closest to the inlet will cool down the strongest.

At this location, a largest temperature difference with the heating means will be present, so that a most optimal heat transfer between the heating means and the rotor is possible.

Due to a thermal conductivity of the shaft, heat transferred to the shaft will be spread over the entire shaft and a rotor body of the rotor.

As a result, the temperature gradient over the rotor from an inlet side to an outlet side of the element, which would occur in already known elements, can be eliminated and the entire rotor will be at almost the same temperature.

As a result thereof, a thermal deformation of the rotor will be kept limited, such that tolerances and clearances between the rotor and the housing are maintained within acceptable limits and thermal stresses remain limited.

In a preferred embodiment of the element according to the invention, the heating means comprises a first injection circuit for injecting a heating medium at a temperature higher than the low temperature to the end of the shaft of the rotor located closest to the inlet.

The heating means which ends up on this end of the shaft of the rotor, comes in direct contact with this end, which facilitates a heat exchange between this heating means and this aforementioned end.

In a more preferred embodiment of the element according to the invention, the first injection circuit is provided with a nozzle at the aforementioned end of the shaft, which nozzle sprays heating means directly onto the aforementioned end.

The heating means is sprayed directly and targetedly to the aforementioned end of the shaft by the nozzle, so that as large a part of the heating means as possible effectively ends up on the aforementioned end of the shaft and therefore a heat exchange between the injected heat medium and this aforementioned end is facilitated.

In an even more preferred embodiment of the element according to the invention, the rotor is mounted rotatably with respect to the housing by means of bearings and the element is provided with a second injection circuit for injecting heating medium.

As a result, the bearings can now also be heated to prevent these from cooling down too much and from freezing, which could jeopardize a correct operation of the bearings due to an increased friction in the bearings.

Preferably, a first duct of the second injection circuit with a first feed point for heating medium into the element is positioned in a first part of the housing which, according to an axial direction of the shaft, is located at a side of the housing where the inlet is positioned.

Alternatively or additionally, a second duct of the second injection circuit with a second feed point for heating medium into the element is positioned in a second part of the housing which, according to an axial direction of the shaft, is located at a side of the housing where the outlet is positioned.

This has the advantage that, by feeding the heating medium at an inlet side and/or outlet side into the element, a feed point can be provided at one and/or two ends of the rotor.

In other words, the bearings on the inlet side of the element and/or the bearings on the outlet side of the element have their own injection point, so the heating medium is injected as closely as possible to the bearings and it is not necessary to transport the heating medium from the inlet side of the element through the housing to the outlet side of the element or vice versa.

This will prevent the heating medium from freezing or cooling too much during its passage through the housing, which could cause a blockage of the heating medium in the element and/or possibly deteriorate lubrication properties of the heating medium.

Since the heating medium only needs to travel a limited distance through the housing from a feed point to the respective bearings, the heating medium will only cool down marginally, allowing the necessary heat to be maximally transferred to the bearings.

The first feed point and the second feed point are interconnected by means of a connecting duct for heating medium in the housing.

By virtue of the connecting duct, heat transfer is possible between the heating medium which is injected via the first and second feed point.

This heat exchange occurs via the heating medium in the connecting duct to the cold inlet side of the element from the outlet side at a higher temperature.

This will result in a uniform temperature over the entire heating medium, the entire housing and the bearings.

Hence, there is less risk that the heating medium would slow down too much locally in the element.

According to the invention, it is not excluded that the second injection circuit is connected to, is part of, is integrated into or forms a single unit with the first injection circuit.

Therefore, the element is less complex regarding its construction in terms of a required number of channels in the housing for the first and second injection circuit.

In a preferred embodiment of the element according to the invention, the nozzle, if present, is configured to be able to also spray heating medium on the bearings.

In this way, both the end of the shaft of the rotor located closest to the inlet and the bearings at the inlet side of the element are directly and targetedly sprayed with the heating medium, such that a significant part of the heating medium effectively ends up both on the aforementioned end of the shaft and on the bearings and that therefore a heat exchange is facilitated between, on the one hand, the injected heating medium and, on the other hand, this aforementioned end and the bearings.

Preferably, the nozzle is thereby provided with at least two nozzle openings.

In this way, one of the at least two nozzle openings can be targeted to the aforementioned end of the shaft of the rotor and another one of the at least two nozzle openings can be directed to the bearings at the inlet side of the element, such that as large a part of the heating medium as possible effectively ends up on both the aforementioned end of the shaft and the bearings and that therefore a heat exchange is facilitated between, on the one hand, the injected heating medium and, on the other hand, this aforementioned end and the bearings.

The invention also concerns a device for compression of a gas to be compressed having a low temperature of −40° C. or lower, with the characteristic that the device is provided with at least one element according to the invention.

Of course, such a device has the same advantages as the embodiments of the element according to the invention as described hereabove.

The invention also relates to a method for compression of a gas to be compressed having a low temperature of −40° C. or lower by means of an element, which element is provided with a housing containing at least one rotor which is mounted rotatably around its shaft with respect to the housing and with an inlet for the gas to be compressed and an outlet for compressed gas, with the characteristic that an end of the shaft of the rotor located closest to the inlet is heated.

Preferably, the gas to be compressed having a low temperature has a temperature of maximally −60° C., and preferably maximally −100° C.

In a preferred embodiment of the method according to the invention, a heating medium is injected to aforementioned end, whereby the heating medium has a temperature higher than the gas to be compressed.

In more preferred embodiment of the method according to the invention, the rotor is rotatably mounted with respect to the housing by means of bearings and the heating medium is also injected to the bearings.

Of course, the advantages of such a method overlap with the advantages of the corresponding embodiments of the element according to the invention as described hereabove.

Preferably, the heating medium is a lubricating liquid, more preferably oil.

Therefore, the heating medium is not only usefully applicable for the heating, but also for the lubrication of components of the element, which is mainly of interest to the bearings.

Finally, the invention also relates to a use of an element or a device according to the invention for compression of a gas to be compressed having a low temperature of −40° C. or lower.

BRIEF DESCRIPTION OF THE DRAWINGS

With a view to better demonstrate the characteristics of the invention, as example without any restrictive character, a number of preferred embodiments of an element for compressing a gas to be compressed having a low temperature according to the invention and a device provided with such an element are described here below, with reference to the accompanying drawings, wherein.

DETAILED DESCRIPTION

Figure 1:
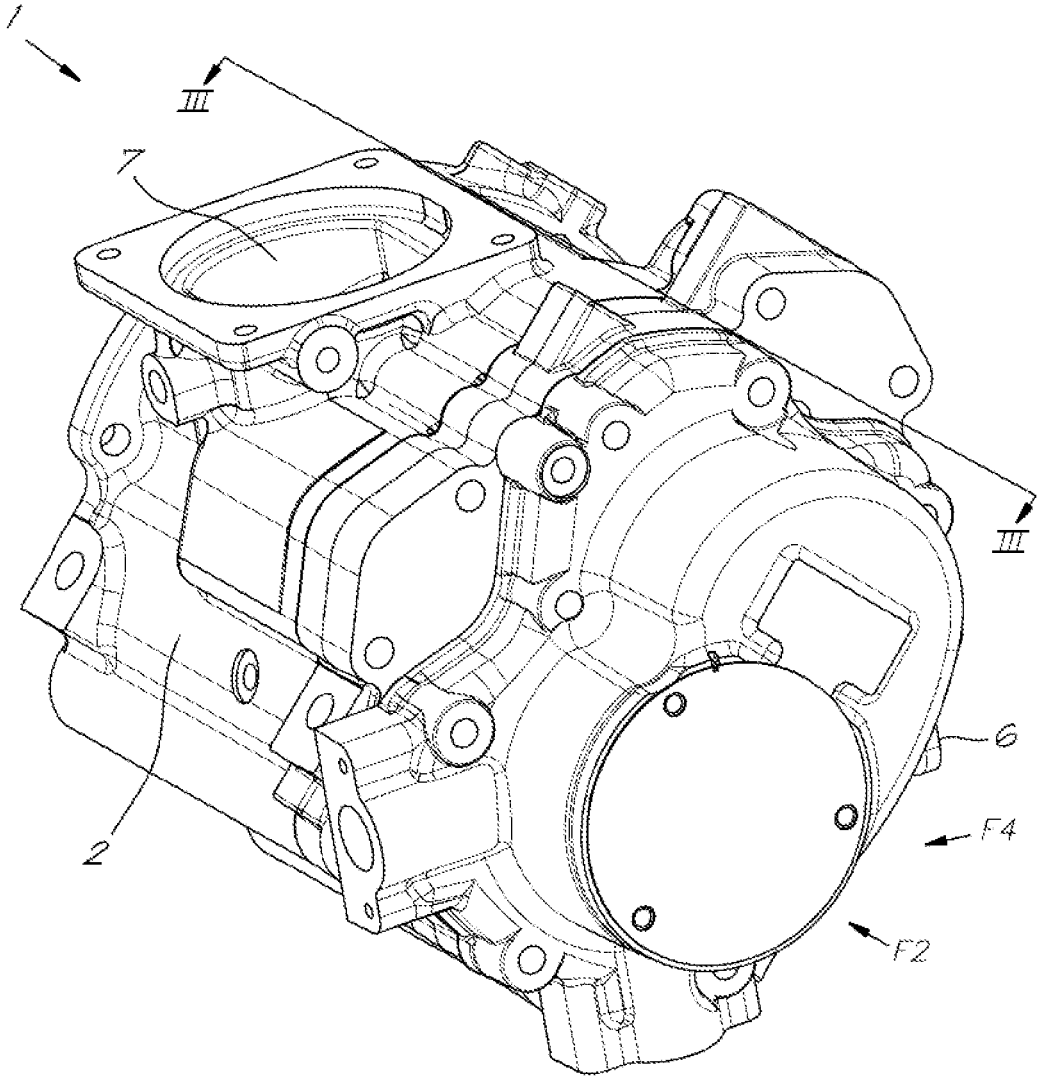
FIG. 1 shows schematically and in perspective an element according to the invention for use in a device according to the invention.
Figure 2:
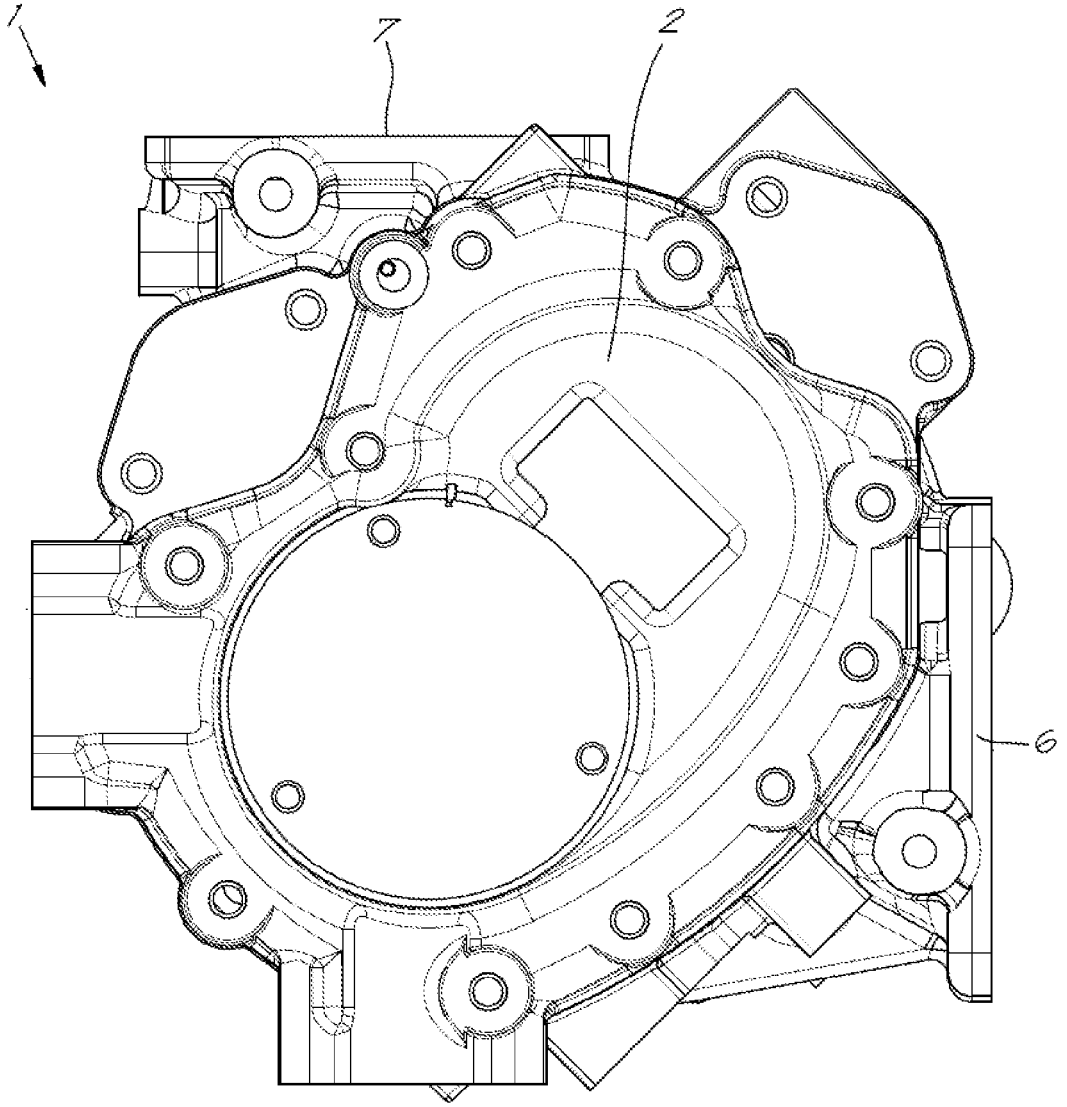
FIG. 2 shows a view according to arrow F2 in FIG. 1.

The element 1 according to the invention shown in the figures for use in a device according to the invention, is in this case a screw compressor element.

The element 1 comprises a housing 2 containing therein at least one rotor 3, in this case two helical rotors.

The screw compressor element is in this case an oil-free screw compressor element, i.e. no oil is injected into a compression chamber in the housing 2 of the element 1 for lubrication and/or sealing of the helical rotors.

The helical rotors are arranged rotatably with their shafts 5 with respect to this housing 2 by means of bearings 4.

The housing 2 also comprises an inlet 6 for gas to be compressed having a low temperature and an outlet 7 for the compressed gas.

According to the invention, the temperature of the gas to be compressed at low temperature is −40° C. or lower and preferably, but not necessary for the invention, −60° C. or lower, and more preferably −100° C. or lower.

Obviously, as a consequence of the compression, the compressed gas will have a higher temperature than the gas to be compressed before compression. Depending on the process, this temperature may higher than −100° C., −60° C. or −40° C.

Figure 3:
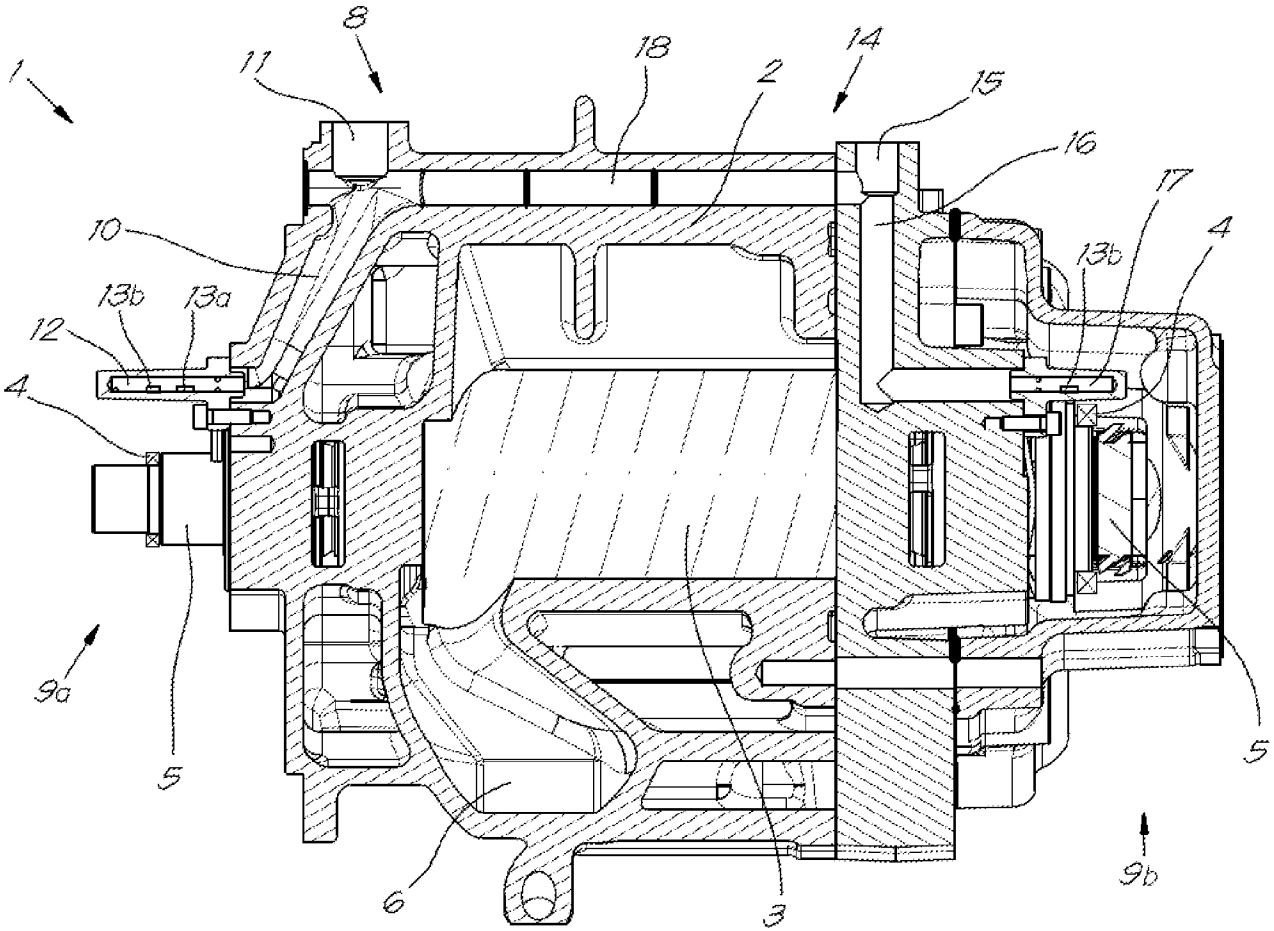
FIG. 3 shows a cross-section according to line III-III in FIG. 1.

According to the invention, the element 1 is provided with a first injection circuit 8 for the injection of a heating medium at a higher temperature than the low temperature to the end 9*a* of the shaft 5 of the rotor 3 located closest to the inlet 6. This is shown in FIG. 3.

It is important to note that this first injection circuit 8 is used to inject heating medium to the end 9*a* of the shaft 5 of the rotor 3 located closest to the inlet 6. In other words, the first injection circuit 8 is not used to inject oil into the compression chamber.

This first injection circuit 8 comprises a first duct 10 with a first feed point 11 for heating medium in the element 1. Through this first feed point 11, heating medium is brought from a heating medium reservoir into the housing 2.

In addition, the first injection circuit 8 comprises a nozzle 12, situated at the aforementioned end 9*a* of the shaft 5, which nozzle injects heating medium directly on the aforementioned end 9*a*.

Figure 4:
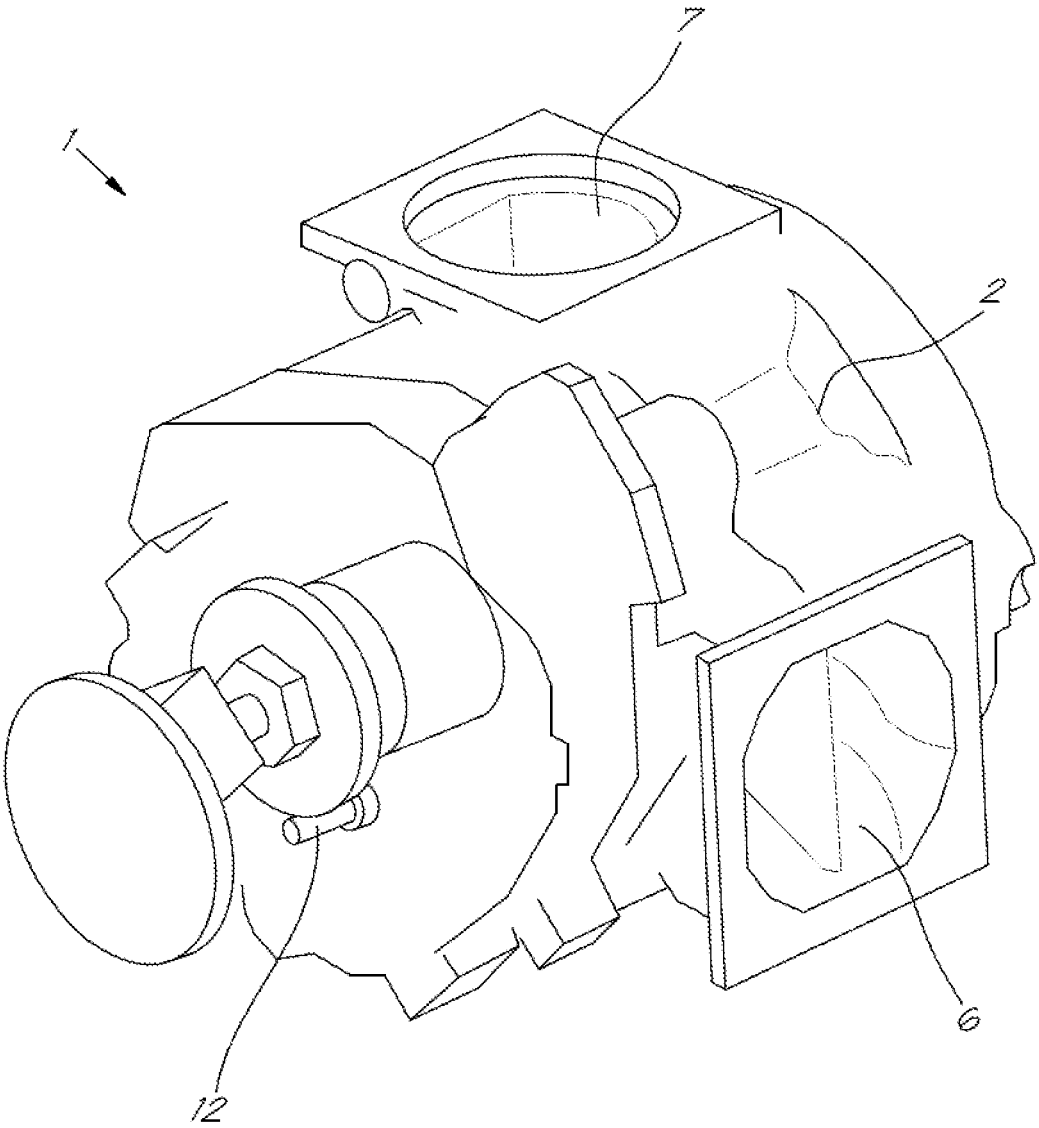
FIG. 4 shows schematically and in perspective a view according to arrow F4 in FIG. 1, but with partial cut away of the housing.

The nozzle 12, shown in FIGS. 3 and 4, is provided with a nozzle opening 13*a* for this purpose.

In the example shown, the element 1 is provided with a second injection circuit 14.

It should be noted that this second injection circuit 14 is used to allow the injection of heating medium to the bearings 4. In other words, the second injection circuit 14 is not used to inject oil into the compression chamber.

As shown in FIG. 3, the second injection circuit 14 is provided with two feed points 11, 15 for heating medium into the element 1 at two different locations in the housing 2.

As shown, there is a feed point 11, 15 in the housing 2 at each end 9*a*, 9*b* of the helical rotor 3.

As a result, heating medium can be injected into the housing 2 as closely as possible near the bearings 4 at the ends 9*a*, 9*b* of the shaft 5 of the rotor 3.

From the feed points 11, 15, ducts 10, 16 will run through the housing 2 to the bearings 4 to supply the heating medium up to the bearings 4.

At the location of the bearings 4, suitable nozzles 12 and 17 are provided.

The nozzles 12 and 17 are provided with nozzle opening 13*b* to spray heating medium on the bearings 4.

As shown in FIG. 3, the two feed points 11, 18 are interconnected by means of a connecting duct 18 for heating medium in the housing 2.

This connecting duct 18 will be filled with oil while the device is operating.

As can be seen in FIG. 3, the first injection circuit 8 and the second injection circuit 14 share in this case the feed point 11, the duct 10 and the nozzle 12.

In this case, but not necessary for the invention, the first injection circuit 8 is therefore part of the second injection circuit 14.

It is also possible that the second injection circuit 14 is connected to, is part of, is integrated into or forms a single unit with first injection circuit 8.

Of course, it is also possible that the first injection circuit 8 and the second injection circuit 14 are completely separated from each other.

It is also the case that the nozzle 12 sprays oil on the end 9*a* of the shafts 5, but also oil on the bearings 4.

In other words: the nozzle 12 has a double function in this case.

To this end, the nozzle 12 is provided with two nozzle openings 13*a* and 13*b*.

The screw compressor element operates in a very simple way and as follows.

During operation of the screw compressor element, the helical rotors will run cooperatively by intermeshing and draw in gas to be compressed at low temperature through the inlet 6 in the housing 2.

The gas to be compressed is compressed by means of the helical rotors and will exit the screw compressor element 1 through the outlet 7 in the housing 2.

Hereby, the gas to be compressed at low temperature will strongly cool the housing 2.

Although the temperature of the gas will increase during the compression process, the temperature of the gas will still be so low that after compression the compressed gas will still cool the housing 2.

During the operation of the element 1, heating medium will be conveyed via the feed point 11 and the duct 10 to the nozzle 12. The heating medium will be sprayed through the nozzle opening 13*a* on the end 9*a* of the shaft 5 of the rotor 3 located closest to the inlet 6.

The end 9*a* will be warmed up and the heat will spread through the shaft 5 over the entire rotor 3.

Since the inlet 6 is the coldest location of the housing 2, the strongest heating will be required here.

Due to the thermal conductivity of the shaft 5, the heat will go up to the end 9*b* of the shaft 5 located furthest away from the inlet 6.

As a result of this, the temperature in the entire rotor 3 will be kept as high as possible, and the temperature will also be uniform.

As a result of the heating of the rotor 3, the bearings 4 will also indirectly be partially heated.

However, in order to ensure proper operation of the bearings 4, the second injection circuit 14 will spray heating medium at a higher temperature than the low temperature on the bearings 4.

For the bearings 4 on each end 9*a*, 9*b* of the shaft 5 of the rotor 3, a special feed point 11, 15 is provided in the housing 2, allowing the heating medium to be brought to the bearings 4 using the shortest possible duct 10, 16.

Through the nozzles 12, 17 and their nozzle openings 13*b*, the heating medium is sprayed directly on the bearings 4.

This will minimize a drop in the temperature of the heating medium when passing through the cold housing 2, before the heating medium reaches the bearings 4.

The connecting duct 18, which provides a connection between the two feed points 11, 15, is intended to allow heat exchange between the heating medium injected through both feed points 11, 15.

This connecting duct 18 will be filled with heating medium and although this heating medium is normally stationary and will not reach the bearings 4, heat exchange will still be possible via the heating medium in the connecting duct 18 to the very cold inlet 6 from the outlet 7 at a higher temperature.

This will ensure an even temperature across the entire heating medium in the housing 2, the entire housing 2 and the bearings 4.

Hereby, there is also no risk that the heating medium will cool down too much.

The present invention is by no means limited to the embodiments described as example and shown in the figures, but an element for compressing a gas to be compressed having a low temperature according to the invention and a device provided with such an element may be implemented in all forms and dimensions without going beyond the scope of the invention as defined in the claims.

The invention claimed is:

1. Element for compression of a gas to be compressed having a low temperature of −40° C. or lower, the element (1) is provided with a housing (2) containing at least one rotor (3) which is mounted rotatably around its shaft (5) with respect to the housing (2) and with an inlet (6) for the gas to be compressed and an outlet (7) for compressed gas, characterized in that the element (1) is provided with a heating means for an end (9*a*) of the shaft (5) of the rotor (3) located closest to the inlet (6), characterized in that the heating means comprises a first injection circuit (8) for injecting a heating medium at a temperature higher than the low temperature to said end (9*a*) of the shaft (5) of the rotor (3), and characterized in that the rotor (3) is mounted rotatably with respect to the housing (2) by means of bearings (4) and that the element (1) is provided with a second injection circuit (14) for injecting heating medium at a temperature higher than the low temperature to the bearings (4).

2. The element according to claim 1, characterized in that the low temperature of the gas to be compressed is −60° C. or lower.

3. The element according to claim 2, characterized in that the low temperature of the gas to be compressed is −100° C. or lower.

4. The element according to claim 1, characterized in that the first injection circuit (8) is provided with a nozzle (12) located at the aforementioned end (9*a*) of the shaft (5), the nozzle (12) sprays the heating medium directly onto the aforementioned end (9*a*).

5. The element according to claim 4, characterized in that the nozzle (12) is configured to be able to also spray heating medium on the bearings (4).

6. The element according to claim 5, characterized in that the nozzle (12) is provided with at least two nozzle openings (13*a*, 13*b*).

7. The element according to claim 1, characterized in that a first duct (10) of the second injection circuit (14) with a first feed point (11) for heating medium into the element (1) is positioned in a first part of the housing (2) which, according to an axial direction of the shaft (5), is located at a side of the housing (2) where the inlet (6) is positioned.

8. The element according to claim 7, characterized in that a second duct (16) of the second injection circuit (14) with a second feed point (15) for heating medium into the element (1) is positioned in a second part of the housing (2) which, according to an axial direction of the shaft (5), is located at a side of the housing (2) where the outlet (7) is positioned.

9. The element according to claim 8 characterized in that the first feed point (11) and the second feed point (15) are interconnected by means of a connecting duct (18) for heating medium in the housing (2).

10. The element according to claim 1, characterized in that the second injection circuit (14) is connected to, is part of, is integrated into or forms a single unit with the first injection circuit (8).

11. The element according to claim 1, characterized in that the element (1) is a screw compressor with at least one helical rotor.

12. The element according to claim 11, characterized in that the element (1) is an oil-free screw compressor.

13. The element according to claim 11, characterized in that the screw compressor has two helical rotors.

14. A device for compression of a gas to be compressed having a low temperature of −40° C. or lower, characterized in that the device is provided with at least one element (1) according to claim 1.

15. A method for compression of a gas to be compressed having a low temperature of −40° C. or lower by means of an element, which element (1) is provided with a housing (2) containing at least one rotor (3) which is mounted rotatably around its shaft (5) with respect to the housing (2) and with an inlet (6) for the gas to be compressed and an outlet (7) for compressed gas, characterized in that an end (9*a*) of the shaft (5) of the rotor (3) located closest to the inlet (6) is heated by a first injection circuit (8) for injecting a heating medium at a temperature higher than the low temperature to said end (9*a*) of the shaft (5) of the rotor (3), and characterized in that the rotor (3) is mounted rotatably with respect to the housing (2) by means of bearings (4) and the bearings (4) are heated by a second injection circuit (14) for injecting heating medium at a temperature higher than the low temperature to the bearings (4).

16. The method according to claim 15, characterized in that the gas to be compressed at low temperature has a temperature of −60° C. or lower.

17. The method according to claim 15, characterized in that the heating medium has a temperature higher than the gas to be compressed.

18. The method according to claim 17, characterized in that the heating medium is a lubricating liquid.

19. The method according to claim 18, characterized in that the lubricating liquid is oil.

20. The method according to claim 15, characterized in that the first injection circuit (8) is provided with a nozzle (12) located at the aforementioned end (9*a*) of the shaft (5), and said end (9*a*) of the shaft (5) of the rotor (3) is heated with a heating medium by spraying the heating medium from the nozzle (12) directly onto the aforementioned end (9*a*).

* * * * *